United States Patent [19]

Hadzoglou

[11] Patent Number: 4,839,660

[45] Date of Patent: Jun. 13, 1989

[54] CELLULAR MOBILE COMMUNICATION ANTENNA

[75] Inventor: James Hadzoglou, Mayfield Heights, Ohio

[73] Assignee: Orion Industries, Inc., Solon, Ohio

[21] Appl. No.: 799,202

[22] Filed: Nov. 19, 1985

Related U.S. Application Data

[63] Continuation of Ser. No. 535,273, Sep. 23, 1983, abandoned.

[51] Int. Cl.[4] ..... H01Q 1/32

[52] U.S. Cl. ..... 343/715; 343/745; 343/846; 343/861

[58] Field of Search ..... 343/706, 708–713, 343/715, 745, 749, 846–848, 850–852, 860, 861, 905, 906; 361/290, 291

[56] References Cited

U.S. PATENT DOCUMENTS

| | | | |
|---|---|---|---|
| 2,206,820 | 7/1940 | Mydlil | 343/745 |
| 2,541,107 | 2/1951 | Selgin | 343/830 |
| 2,920,323 | 1/1960 | Dunson | 343/850 |
| 3,268,897 | 8/1966 | Link | 343/713 |
| 3,573,628 | 4/1971 | Cramer et al. | 343/702 |
| 3,808,556 | 4/1974 | Dome | 361/290 |
| 4,089,817 | 5/1978 | Kirkendall | 343/713 |
| 4,184,160 | 1/1980 | Affronti | 343/712 |
| 4,238,799 | 12/1980 | Parfitt | 343/715 |
| 4,543,581 | 9/1985 | Nemit | 343/702 |

*Primary Examiner*—Rolf Hille
*Assistant Examiner*—Michael C. Wimer
*Attorney, Agent, or Firm*—Dressler, Goldsmith, Shore, Sutker & Milnamow, Ltd.

[57] ABSTRACT

A mobile antenna system for use at frequencies in and above the 800 MHz band having a collinear radiator mounted on one surface of a dielectric such as the window of a vehicle and a tunable coupling circuit disposed internally of a conducted housing mounted on the opposite surface of the dielectric which acts as a counterpoise for coupling RF energy between the radiator and a transmission line connected to a suitable transceiver.

52 Claims, 2 Drawing Sheets

CELLULAR MOBILE COMMUNICATION ANTENNA

This application is a continuation, of application Ser. No. 535,273, filed Sept. 23, 1983, abandoned.

FIELD OF THE INVENTION

The present invention relates to communications antennas and more particularly to mobile communications antennas for frequencies in the area of the 800 MHz frequency band of the type adapted to be mounted on a non-conductive surface such as a vehicle windshield.

BACKGROUND OF THE INVENTION

The recent introduction of cellular telephone service which utilize frequencies in the 800 MHz frequency band and above, has increased interest in the efficient mobile antenna systems for those fequencies. Such services typically utilize a fairly wide band width. For example, existing and/or proposed systems operate over frequency bands of about 800–870 MHz, 820–900 MHz and 860–940 MHz. As can be seen by the above figures, the band width of such operating systems ranges from between about 60 to about 80 MHz. Thus, any antenna designed for use with such systems should provide efficient radiation characteristics and low VSWR over these band widths.

In addition, mobile antennas for such communications systems are designed to be mounted on vehicles. Some type of permanent installation is often necessary. For preferred locations, those which provide the most uniform radiation patterns, such as roof tops, this requires mounting to the vehicle such as automobiles by cutting holes into the body and permanently mounting the antennas in place. This is not always a satisfactory arrangement for vehicle owners.

Alternate mounting locations, such as fenders or trunk lids, which may allow for different mounting techniques, result in deterioration in the desired uniformity in the radiation pattern. It would be desirable, therefore to have an antenna which could operate at these UHF frequencies and which at the same time could provide the desired operating characteristics without requiring the mounting arrangements that permanently mar a vehicle and require body repair when the antenna system is removed from the vehicle.

The mounting of a communications antenna on insulated surfaces such as the windshield of an automotive vehicle is known for much lower frequencies. One such an antenna system is disclosed in commonly assigned U.S. Pat. No. 4,238,799 which issued on Dec. 9, 1980, incorporated herein by reference.

The antenna system there specifically disclosed is particularly adapted for operation at frequencies well below the frequencies used for cellular phone communication systems. Thus, the antenna there disclosed was designed for operation in the CB and related bands of about 28–29 MHz.

Antennas similar to and adapted from the antenna disclosed in the aforesaid U.S. Pat. No. 4,238,799 have been designed and operate at somewhat higher frequencies than those disclosed in that patent. However, although the electrical schematic representation of the circuit remains the same as that shown in FIG. 4 of that patent, as frequencies increase and reach the frequencies utilized in cellular phone systems, those at and above the 800 MHz band, the structure utilized for lower frequencies is no longer appropriate.

Furthermore, the antenna disclosed in the aforesaid patent is a relatively narrow band antenna which does not operate satisfactorily over the wide frequency bands which are required for cellular phone systems.

SUMMARY OF THE INVENTION

In accordance with the present invention, there is provided a communications antenna adapted to operate at and above the 800 MHz frequency band which is designed for mounting on an insulated surface such as the windshield of an automotive vehicle and which provides excellent efficiency and gain as well as the desirable band width to allow for efficient use at the cellular communications frequencies under consideration.

In accordance with the present invention, a vehicle window, e.g., the windshield is utilized to efficiently couple RF energy to a two-element collinear radiator mounted on the external surface of the windshield. In order to couple the RF energy between the antenna and a transceiver, a specially designed coupler configuration is mounted on the inner surface of the window in proximity to the antenna mount. The coupler reactively couples the radiator element to a transmission line while providing the desired 50 ohm input impedance.

The coupler in accordance with the present invention together with the radiator designed for use therewith provides desired VSWR characteristics over the operating band ranges of 60 to 80 MHz such as contemplated for use in cellular telephone systems.

In accordance with the present invention, specially designed tuning circuit elements are utilized and are disposed in a conductive coupler box which acts as a counterpoise for the antenna radiator. The window mounted antenna incorporating the present invention is capable of providing radiation characteristics comparable to antennas mounted on the roof tops of vehicles, provides desired omni-directional coverage and satisfactory gain without the distortion which may arise from mounting antennas on trunk lids and other less satisfactory locations on a vehicle.

More specifically, the communications antenna system incorporating the present invention utilizes a collinear radiator having a $\frac{5}{8}$ wave-length upper radiator and a lower radiator having an electrical length of between about $\frac{1}{4}$ and $\frac{1}{2}$ wave-length separated by an air-wound phasing coil.

One advantage of the glass mounted antenna system as set forth in the above-mentioned patent is the elimination of the ground plane and the resultant uniformity of radiation pattern independent of vehicle configuration. At the frequencies at which the assembly incorporating the present invention is used, however, one problem that arises is that the transmission line connecting the antenna assembly to the transceiver becomes "hot".

In order to eliminate this problem, the coupling or feed assembly is incorporated in a conductive housing which acts as a counterpoise. Disposed within the conductive housing are the components defining a coupling capacitor plate, and the tuned circuit utilized to tune the antenna and couple the radiator mounted on the external surface of the glass to the transmission line.

The configuration of the components disposed within the coupling or feed housing are significantly different than those that were suitable for use in the antenna disclosed in the aforesaid patent. Thus, the coupling capacitor plate forming a part of the feed housing is a printed circuit foil embedded in a dielectric sheet forming one side of the housing which is affixed to the vehicle window, such as by adhesive. The plate of the coupling capacitor also acts as the plate of the adjustable tuning capacitor. The other plate of the tuning capacitor is a generally U-shaped member. The base of the U is affixed to and in contact with the metallic housing forming the counterpoise. One leg of the U shaped plate, oriented at substantially 90° to the base, provides the ground or shield connection to a transmission line connector. The second leg forms the other plate of the tuning capacitor. The second leg extends at an obtuse angle to the base of the U and has a free end bent back to form a return oriented generally parallel to the base thereof. The return portion extends over at least a portion of the coupling plate or embedded foil element to define the adjustable coupling capacitor.

The adjustment of the capacitor is achieved by adjusting the position of the free end return and thereby adjusting the amount of overlap between that plate of the tuning capacitor and the foil coupling plate. The dielectric member in which the coupling plate is embedded forms the closure for the conductive housing or counterpoise.

The inductor is defined by a straight wire having a dimension suitable to the frequencies at which the antenna is to be tuned. The wire extends between and is electrically connected to the base of the generally U-shaped conductor and the foil coupling plate. The center conductor of the transmission line connector is electrically connected to the inductor at an appropriate tap point along its length whereby the impedence of the tuning circuit is matched to the 50 ohm impedance of the transmission line.

By utilizing a through-the-glass antenna assembly in accordance with the present invention, there is provided an antenna system capable of producing omnidirectional radiation at and above the 800 MHz band having a band width defined by a VSWR less than 1.5 over a range of about 60–80 MHz rendering the antenna suitable for use as a cellular phone system antenna providing desired gain and band width capabilities. At the same time, by use of the antenna system incorporating the present invention, the transmission line connecting the antenna to the transceiver is not hot, thereby eliminating one safety concern.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF A PREFERRED EMBODIMENT

Figure 1:
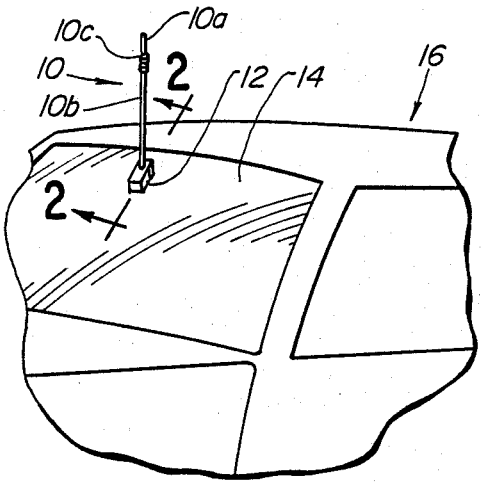
FIG. 1 is a perspective view showing installation of an antenna on a windshield.
Figure 2:
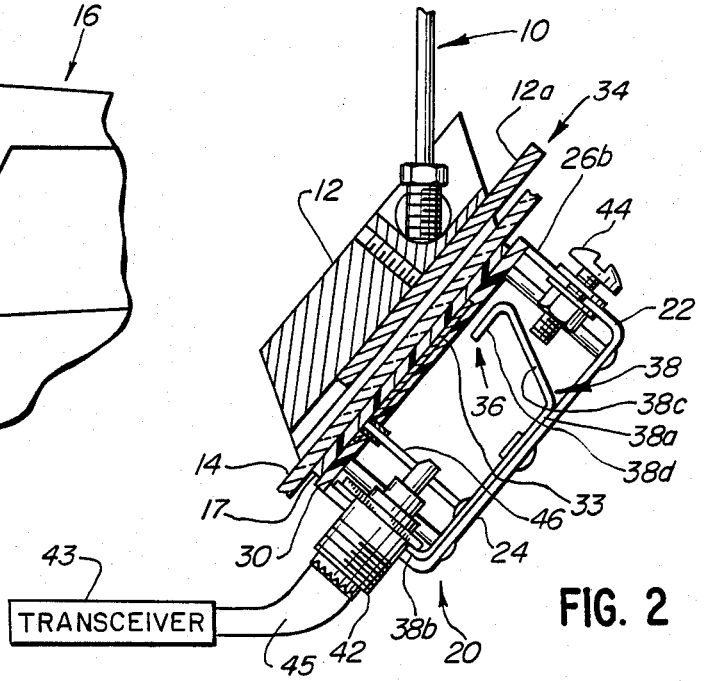
FIG. 2 is an enlarged cross-section taken along lines 2—2 of FIG. 1.
Figure 3:
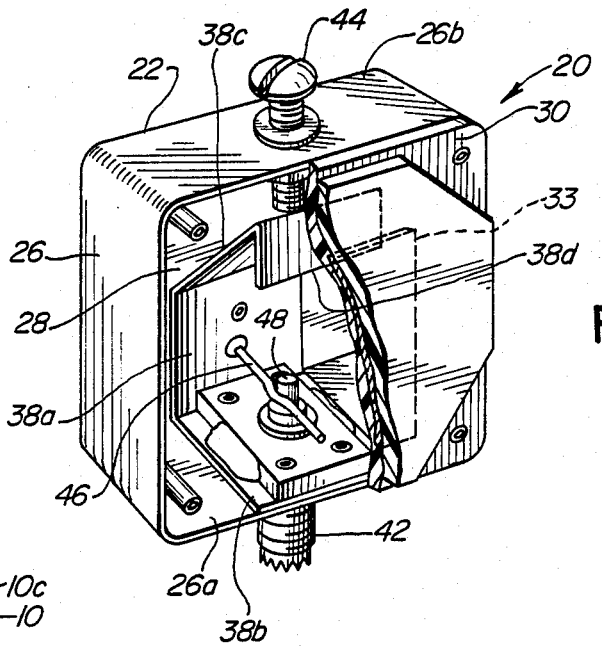
FIG. 3 is a perspective view, partially broken away of a feed or coupling assembly in accordance with the present invention.
Figure 5:
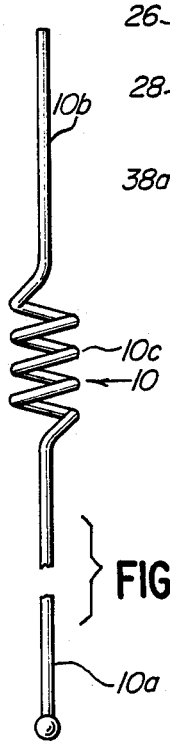
FIG. 5 is an elevation showing a suitable antenna radiator.
Figure 4:
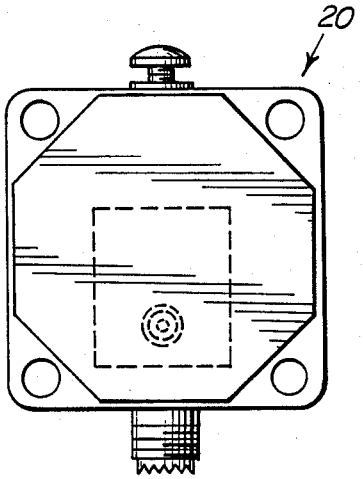
FIG. 4 is an elevation of the coupling housing.

While this invention is susceptible of embodiment in many different forms, there is shown in the drawing and will be described herein in detail a specific embodiment thereof with the understanding that the present disclosure is to be considered as an exemplification of the principles of the invention and is not intended to limit the invention to the specific embodiment illustrated.

Referring to the drawings there is shown an antenna system incorporating the present invention. The antenna system includes an elongated collinear radiator 10 comprising an upper section **10*a* having an electrical length of approximately $\frac{5}{8}$ wavelength, and lower section 10*b* having an electrical length in excess of $\frac{1}{4}$ wavelength separated by an air wound phasing coil 10*c*** having a length suitable for proper phasing at the frequency at which the antenna is to be used.

The radiator terminates in a base or foot 12 such as one shown in U.S. Pat. No. 4,238,799 or U.S. Pat. No. 4,266,227 having a generally flat surface adapted to be suitably affixed to the outer surface of a dielectric member such as a windshield 14 of a vehicle 16. A coupling or feed assembly 20 is affixed to the inner surface of the windshield 14, such as by adhesive 17, juxtaposed to the antenna base member 12.

The feed assembly 20 includes a conductive housing 22 having a front wall 24 and four side walls 26 with an open back 28. The conductive housing acts as a counterpoise for the antenna system and thereby results in the feed or transmission line between the antenna system and the transceiver remaining "cold".

A metal member **12*a*, attached to or forming part of the base 12 forms one plate of a coupling capacitor 34. The capacitor 34 couples radio frequency energy to and from the radiator 10. The open back 28 is closed by a dielectric circuit board 30 having formed therein a conductive foil plate 33 which defines the second plate of the coupling capacitor 34 on opposite sides of the windshield 14**.

The inner coupling plate 33 also forms one plate of an adjustable tuning capacitor 36. The other plate of capacitor 36 is defined by a generally U-shaped bent member 38 having a generally planar base portion **38*a* lying along and affixed to the inner surface of front wall 24 of the conductive housing 22. A standard transmission line coaxial connector 42 is disposed in one side wall 26*a* of the housing 22, and is connected to a transceiver 43 by means of a coaxial cable 45. The shield connection of the connector 42 is electrically connected to the housing 22 and to one leg 38*b* of the second tuning capacitor plate or U-shaped member 38 disposed generally perpendicular to the base 38*a*** of the capacitor plate.

The other free leg **38*c* of the bent member 38 extends at a generally obtuse angle from the base 38 with the freen end bent back to form a return 38*d* which overlaps and is spaced from the foil coupling plate 33. Adjustment of the capacitor 36 is achieved by utilizing a nonconductive member 44 which passes through the side wall 26*b* and engages the free end or leg 38*c* of the tuning capacitor plate 38 to displace the leg 38*c* inwardly and outwardly. This adjusts the amount of overlap between the capacitor plate return 38*d* and the coupling plate 33** to adjust the amount of capacitance thereof as is well known.

An inductor 46 in the form of a straight wire having a diameter to produce an inductance appropriate to the frequency to which the system is to be tuned is electrically connected to the base 38a of the adjustable capacitor plate 38 and to the foil 33 formed in the PC board dielectric. The center conductor 48 of the transmission line connector 42 is electrically connected to the inductor/wire 46 at a point between its ends to match the impedance of the transmission line itself of about 50 ohms.

Radio frequency energy is coupled from the center conductor 48 of the connector 42 through a part of the inductor/wire 46 to the plate 33 of the coupling capacitor 34. That energy is in turn coupled through the glass member 14 to the second plate 12a and then to the radiating member 10.

Figure 6:
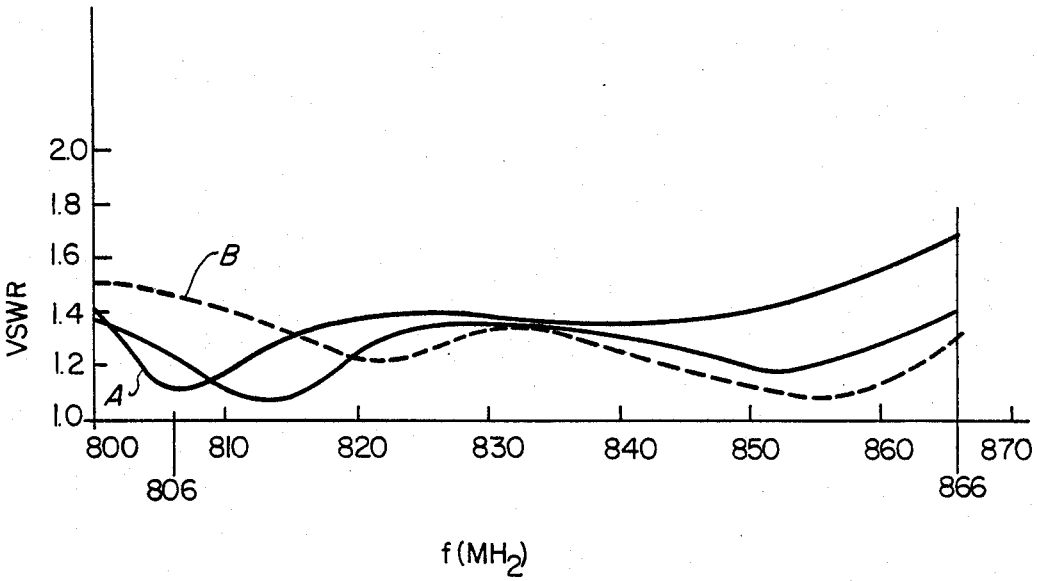
FIGS. 6 and 7 are VSWR plots for the antenna incorporating the present invention.
Figure 7:
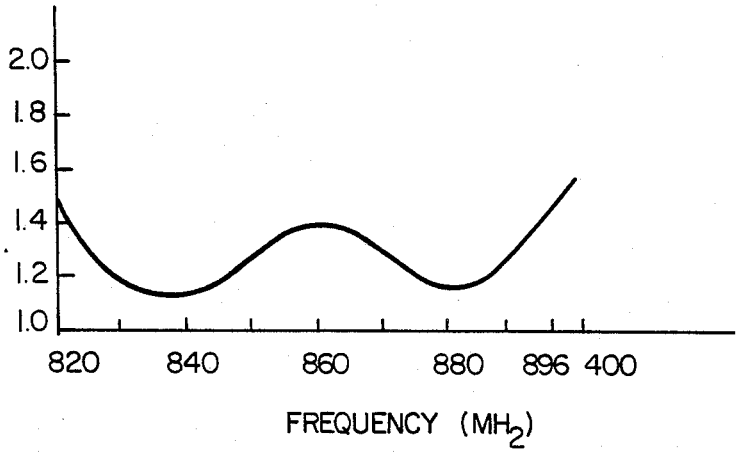

A system so constructed is capable of providing significant band width over the desired range of at about 60 to 80 MHz. For example, in one embodiment of the antenna system incorporating the present invention an antenna was tuned at 806 MHz and maintained a VSWR below 1.5 between frequencies of about 800 MHz and about 860 MHz as shown at A in FIG. 6. An antenna tuned to 820 MHz maintained VSWR equal or less than 1.5 between a frequency of about 802 MHz to excess of 865 MHz as shown in B in FIG. 6. Another antenna that was designed for use in the 821–896 MHz band maintained a VSWR at or below 1.5 between the frequencies of 820 MHz and 895 MHz, as shown in FIG. 7.

Such an antenna system was able to provide a uniform radiation pattern as a function of radiation angle with a uniformity substantially similar to a roof mounted antenna and substantially better than trunk and cowl mounted antennas. Such uniformity is especially important for cellular phone type systems since communications using such systems occur in all directions and any reduction of gain in any particular direction would adversely affect the quality and ability of the mobile system to maintain communications.

Thus there has been disclosed a mobile communications antenna system capable of use in the 800 MHz frequency band and above which does not require affixing to the metallic or conductive surface of a vehicle with the resulting damage thereto, which provides desired uniformity of transmission as a function of horizontal angle which provides satisfactory gain in all direction and which eliminates any concern or problem of having a hot cable disposed within the passenger compartment of such vehicles.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims, all such modifications as follow within the scope of the claims.

What is claimed is:

1. A mobile communications antenna system for use at UHF frequencies at least as high as 800 MHz comprising:

an elongated radiating member attached at one end to a conductive base member affixed to the outer surface of a non-conductive dielectric member of a vehicle; and a coupling system disposed on the inner surface of said dielectric member and juxtaposed with said base member, said coupling system including a conductive housing defining a counterpoise for said antenna system and a coupling plate member juxtaposed with said base member to define therewith a coupling capacitor for RF energy, said coupling plate member being electrically insulated from said conductive counterpoise housing, a tuned circuit connected to said coupling capacitor and disposed within said conductive counterpoise housing for tuning said antenna system to a desired frequency within said 800 MHz band, and a connector member for a coaxial transmission line electrically connected to said tuned circuit at a point at which the impedance of the transmission line connected to said connector and said tuned circuit are substantially the same.

2. An antenna system as claimed in claim 1 wherein said coupling plate member is a printed circuit foil formed in a non-conductive closing member closing one side of said conductive counterpoise housing; and including means for affixing said non-conductive closing member to the inner surface of said vehicle dielectric member with the printed circuit foil generally juxtaposed with said base member.

3. An antenna system as claimed in claim 2 wherein said tuned circuit comprises an adjustable tuning capacitor and an inductor connected in parallel therewith, said printed circuit foil coupling plate being one plate of said tuning capacitor, and the other plate comprising a generally U-shaped conductive member having a base portion disposed between and connected to first and second legs, said base portion being affixed to a conductive wall of said housing, said first leg being connected to said connector and said second leg being adjustable and having a free end portion juxtaposed and spaced from said foil coupling plate.

4. An antenna system as claimed in claim 3 including means for adjusting the degree of juxtaposition between the plates of said tuning capacitor.

5. An antenna system as claimed in claim 4 wherein said inductor is a straight wire extending between and connected to said printed circuit foil coupling plate and said base of said U-shaped member.

6. An antenna system as claimed in claim 5 wherein said connector is a coaxial connector having a shield contact connected to said first leg of said U-shaped member and to said conductive counterpoise housing and a center connector connected to said inductor wire.

7. An antenna system as claimed in claim 6 wherein said radiator is a collinear radiator having a first portion having a length about equal to $\frac{5}{8}$ wavelength, a second portion including said base member having a length between about $\frac{1}{4}$ and $\frac{1}{2}$ wavelength, and a phasing coil therebetween.

8. A mobile communications antenna system usable to radiate radio frequency energy generated by a transceiver located in a vehicle at frequencies in excess of 800 MHz and attachable to a dielectric member of the vehicle comprising:

an elongated radiating member attached at one end to a conductive base member, said base member being attachable to a first surface of the dielectric member of the vehicle;

a conductive housing defining a cavity therein, said housing having a non-conductive sidewall;

means, attachable to a second surface of the dielectric member adjacent said base member, for coupling radio frequency energy with frequencies in excess of 800 MHz to said radiating member, said coupling means being affixed to said non-conductive sidewall of said housing;

a coaxial connector with first and second conductors, said first connector conductor being electrically coupled to said housing;

a selectively tunable circuit positioned in said cavity and electrically connected between said coupling means and said second connector conductor; and a coaxial cable having first and second conductors and connectable between said connector and the transceiver with said first connector conductor electrically engaging said first cable conductor and said first cable conductor electrically engaging a selected conductor of the transceiver so as to form only a single conductive path between said housing and the selected conductor in the transceiver.

9. The antenna system of claim 8 wherein said selectively tunable circuit includes means for matching the impedance of said coaxial cable.

10. The antenna system of claim 9 wherein said impedance matching means includes an inductor coupled between said housing and said coupling means.

11. The antenna system of claim 10 wherein said inductor is a straight wire having first and second ends coupled respectively to said housing and said coupling means.

12. The antenna system of claim 11 with said second connector conductor coupled to a selected point between said ends.

13. The antenna system of claim 8 with said conductive housing being a counterpoise for said radiating member.

14. A mobile communications antenna system usable to radiate radio frequency eneergy, the energy being generated by a transceiver located in a vehicle, the antenna system being operable at frequencies in excess of 800 MHz, attachable to a dielectric member of the vehicle and comprising:

an elongated radiating member attached at one end to a supporting member, said radiating member being supportable adjacent the dielectric member of the vehicle;

connector means couplable to the transceiver and having first and second conductors; and a coupling system separate from the vehicle but affixable to the dielectric member, juxtaposed with said supporting member, said coupling system including, conductive means defining a counterpoise for said antenna system, means, spaced from said counterpoise, for coupling radio frequency energy in excess of 800 MHz through the dielectric member to said radiating member, said connector means affixed to said coupling system with said first conductor coupled to said counterpoise, and means for electrically coupling said radio frequency coupling means to said second conductor said antenna system operable with an electrical connection only between said coupling system and the transceiver.

15. An antenna system in accordance with claim 14 with said connector means including a cable having an end engageable with the transceiver and with said counterpoise being electrically coupled by only said cable end to a selected conductor in the transceiver.

16. An antenna system in accordance with claim 14 wherein:

said supporting member includes a conductive base member affixable to a surface of the dielectric member.

17. An antenna system in accordance with claim 16 wherein said base member is affixable to one surface of the dielectric member and the coupling system is affixable to a second surface of said dielectric member.

18. An antenna system in accordance with claim 17 wherein said radio frequency coupling means includes a planar metal member positionable on the second surface, juxtaposed with said base member, thereby forming a coiupling capacitor.

19. An antenna system in accordance with claim 18 wherein said counterpoise includes a shaped metal member at least a portion of which is positionable against the second surface of the dielectric member.

20. An antenna system in accordance with claim 19 wherein said shaped metal member is a conductive housing.

21. An antenna system in accordance with claim 19 wherein said electrically coupling means includes a conducting member coupled between said planar metal member and said second conductor.

22. An antenna system in accordance with claim 19 wherein said electrically coupling means includes an impedance-matching circuit.

23. An antenna system in accordance with claim 19 wherein said electrically coupling means includes a tunable circuit.

24. An antenna system in accordance with claim 19 wherein said connector means includes a coaxial connector one conductor of which is electrically coupled to said shaped metal member and a second conductor of which is electrically coupled to said planar metal member.

25. An antenna system in accordance with claim 19 wherein said connector means includes a cable having first and second conductors couplable to the transceiver with said shaped metal member coupled to a selected electrical connection in the transceiver only by a selected one of said conductors in said cable.

26. An antenna system as claimed in claim 19 wherein said electrically coupling means includes a tuned circuit.

27. A mobile communications antenna system usable to radiate radio frequency energy, the energy being generated by a transceiver located in a vehicle, the antenna system being operable at frequencies in excess of 800 MHz, attachable to a dielectric member of the vehicle, and comprising:

an elongated radiating member attached at one end to a supporting member, said radiating member being supportable adjacent the dielectric member of the vehicle;

connector means couplable to the transceiver and having first and second connectors; and a coupling system separate from the vehicle but affixable to the dielectric member, juxtaposed with said supporting member, said coupling system including, conductive means including a shaped metal member at least a portion of which is positionable adjacent the dielectric member, said shaped metal member defining a counterpoise for said antenna system, means spaced from said counterpoise, for coupling radio frequency energy in excess of 800 MHz through the dielectric member to said radiation member, said connector means being affixed mechanically to said coupling system with said first conductor coupled to said counterpoise, and means for electrically coupling said radio frequency coupling means to said second conductor with said antenna system operable in the absence of any direct electric connection between said counterpoise and the vehicle.

28. An antenna system in accordance with claim 27 wherein said shaped metal member is a conductive housing.

29. An antenna system in accordance with claim 28 with said connector means including a cable having an end engageable with the transceiver with said counterpoise being electrically coupled by only said end to a selected conductor in the transceiver.

30. An antenna system in accordance with claim 28 wherein:

said supporting member includes a conductive base member with said base member being affixable to a surface of the dielectric member.

31. An antenna system in accordance with claim 30 wherein said base member is affixable to one surface of the dielectric member and the coupling system is affixable to a second surface of said dielectric member.

32. An antenna system in accordance with claim 31 wherein said radio frequency coupling means includes a planar metal member positionable on the second surface, juxtaposed with said base member, thereby forming a coupling capacitor.

33. An antenna system in accordance with claim 32 wherein said electrically coupling means includes a conducting member coupled between said planar metal member and said second conductor.

34. An antenna system in accordance with claim 32 wherein said electrically coupling means includes an impedance-matching circuit.

35. An antenna system in accordance with claim 32 wherein said electrically coupling means includes a tunable circuit.

36. An antenna system in accordance with claim 32 wherein said connector means includes a coaxial connector one conductor of which is electrically coupled to said conductive housing and a second conductor of which is electrically coupled to said planar metal member.

37. An antenna system in accordance with claim 32 wherein said connector means includes a cable having first and second conductors couplable to the transceiver with said conductive housing coupled to a selected electrical connection in the transceiver only by a selected one of said conductors in said cable.

38. A mobile communications antenna system usable to radiate radio frequency energy generated by a transceiver located in a vehicle at frequencies in excess of 800 MHz and attachable to a dielectric member of the vehicle comprising:

an elongated radiating member attached at one end to a supporting member, said radiating member being supportable adjacent the dielectric member of the vehicle;

connector means having first and second conductors; and a coupling system separate from the vehicle but affixable to the dielectric member, juxtaposed with said supporting member, said coupling system including, conductive means defining a counterpoise for said antenna system, means, spaced from said counterpoise, for coupling radio frequency energy in excess of 800 MHz through the dielectric member to said radiating member, said connector means being mechanically affixed to said coupling system with said first conductor coupled to said counterpoise, and tunable circuit means for electrically coupling said radio frequency coupling means to said second conductor and with said coupling system cooperating with said connector means and said radiating member such that said antenna system has a bandwidth in excess of 60 MHz.

39. An antenna system in accordance with claim 38 with said connector means having an end engageable with the transceiver with said counterpoise being electrically coupled by only said end of said connector means to a selected conductor in the transceiver.

40. An antenna system in accordance with claim 45 wherein:

said supporting member includes a conductive base member with said base member being affixable to a surface of the dielectric member.

41. An antenna system in accordance with claim 40 wherein said base member is affixable to one surface of the dielectric member and the coupling system is affixable to a second surface of said dielectric member.

42. An antenna system in accordance with claim 41 wherein said coupling means includes a planar metal member positionable on the second surface, juxtaposed with said base member, thereby forming a coupling capacitor.

43. An antenna system in accordance with claim 42 wherein said conductive means includes a shape metal member at least a portion of which is positionable against the second surface of the dielectric member.

44. An antenna system in accordance with claim 43 wherein said shaped metal member is a conductive housing.

45. An antenna system in accordance with claim 43 wherein said tunable circuit means includes an impedance-matching circuit.

46. An antenna system in accordance with claim 45 wherein said impedance matching circuit includes an inductive element.

47. An antenna system in accordance with claim 43 wherein said connector means includes a coaxial connector one conductor of which is electrically coupled to said shaped metal member and a second conductor of which is electrically coupled to said planar metal member.

48. An antenna system in accordance with claim 43 wherein said connector means includes a cable with an end couplable to the transceiver with said shaped metal member coupled to a selected electrical connection in the transceiver only by said end of said cable.

49. A mobile communications antenna system attachable to a dielectric member of a vehicle and usable to radiate radio frequency energy generated by a transceiver located in the vehicle at frequencies at least as high as 800 MHz comprising:

a radiating member and attached means for supporting said radiating member adjacent the dielectric member;

a coupling system affixable to the dielectric member of and insulated thereby from the remainder of the vehicle, said coupling system including, conductive means defining a counterpoise for the antenna system and means for coupling radio frequency energy through the dielectric member to said radiating member; and connector means having first and second ends with said first end electrically coupled to said counterpoise and with said second end of said connector means engageable with the transceiver with said counterpoise being electrically coupled at only said second end to a selected conductor in the transceiver.

50. A mobile communications antenna system attachable to a dielectric member of a vehicle and usable to radiate radio frequency energy generated by a transceiver located in the vehicle at frequencies at least as high as 800 MHz comprising:

a radiating member and attached means for supporting said radiating member adjacent the dielectric member;

a coupling system affixable to the dielectric member of the vehicle and insulated thereby from the remainder of the vehicle, said coupling system including, a conductive housing defining a counterpoise for the antenna system; and means for coupling radio frequency energy through the dielectric member, to said radiating member with said coupling means including impedance matching means.

51. A mobile communications antenna system as in claim 50 wherein said impedance matching means incorporates tuned circuit means.

52. A mobile communications antenna system usable to radiate radio frequency energy, the energy being generated by a transceiver located in a vehicle, the antenna system being operable at frequencies in excess of 800 MHz, attachable to a dielectric member of the vehicle, and comprising:

an elongated radiating member attached at one end to a supporting member, said radiating member being supportable adjacent the dielectric member of the vehicle;

connector means couplable to the transceiver and having first and second conductors; and a coupling system separate from the vehicle but affixable to the dielectric member, juxtaposed with said supporting member, said coupling system including, conductive means defining a counterpoise for said antenna system, means, spaced from said counterpoise, for coupling radio frequency energy in excess of 800 MHz through the dielectric member to said radiating member, said connector means affixed to said coupling system with said first conductor coupled to said counterpoise, and means for electrically coupling said radio frequency coupling means to said second conductor with said antenna system operable in the absence of any direct electrical connection between said counterpoise and the vehicle and with said coupling system cooperating with said connector means and said radiating member such that said antenna system has a bandwidth in excess of 60 MHz.

* * * * *

UNITED STATES PATENT AND TRADEMARK OFFICE

CERTIFICATE OF CORRECTION

PATENT NO. : 4,839,660

DATED : June 13, 1989

INVENTOR(S) : James Hadzoglou

It is certified that error appears in the above-identified patent and that said Letters Patent is hereby corrected as shown below:

Column 5, line 16, insert the word --least-- before the word "about".

Column 9, line 3, change "radiation" to --radiating--.

Column 9, line 11, change "electric" to --electrical--.

Column 10, line 26 (claim 40, line 1), change "45" to --38--.

Signed and Sealed this

Twenty-first Day of May, 1991

*Attest:*

HARRY F. MANBECK, JR.

*Attesting Officer*

*Commissioner of Patents and Trademarks*